US008038490B1

(12) United States Patent
Vanderhye et al.

(10) Patent No.: US 8,038,490 B1
(45) Date of Patent: Oct. 18, 2011

(54) WIND POWERED BOAT

(75) Inventors: Robert A. Vanderhye, McLean, VA (US); Brendon Nunes, Ajax (CA); Gregory J. T. Lowe-Wyide, Oshawaq (CA)

(73) Assignee: Robert A. Vanderhye, McLean, VA (US)

( * ) Notice: Subject to any disclaimer, the term of this patent is extended or adjusted under 35 U.S.C. 154(b) by 1249 days.

(21) Appl. No.: 11/137,557

(22) Filed: May 26, 2005

Related U.S. Application Data

(60) Provisional application No. 60/592,140, filed on Jul. 30, 2004.

(51) Int. Cl.
*B63H 9/00* (2006.01)

(52) U.S. Cl. ..... 440/8

(58) Field of Classification Search ..... 440/8
See application file for complete search history.

(56) References Cited

U.S. PATENT DOCUMENTS

| | | | | |
|---|---|---|---|---|
| 1,697,574 | A | 1/1929 | Savonius | |
| 1,766,765 | A | 6/1930 | Savonius | |
| 2,677,344 | A | 5/1954 | Annis | |
| 3,212,470 | A | 10/1965 | Wiggin | |
| 4,274,011 | A | 6/1981 | Garfinkle | |
| 4,371,346 | A | 2/1983 | Vidal | |
| 4,522,600 | A | 6/1985 | Jost | |
| 4,684,817 | A * | 8/1987 | Goldwater | 290/55 |
| 4,813,366 | A * | 3/1989 | Elder | 114/290 |
| 6,030,045 | A * | 2/2000 | Hoshino | 297/461 |
| 6,293,835 | B2 | 9/2001 | Gorlov | |
| 2005/0186073 | A1 * | 8/2005 | Krakowski | 416/62 |

OTHER PUBLICATIONS

"New Rotor Ship Sails in Lightest Wind", Popular Science, Jul. 1933.

Sanderson, "Experiments With Model Vertical Axis Windmills", etc., AYRS No. 91, Mar. 1979, pp. 4-13, 30, 31, 46-49, 52-54.

Gigliobianco, "A Self Trimming Vertical Axis Windmill Propelled Catamaran", AYRS 112, Feb. 1993, pp. 29-32.

Sinclair, "Autogiro Boats", Dec. 5, 1995, www.users.globalnet.co/uk/~fsinc/yachts/auto.

"Winding Upward with Corks and Turbines" Sep. 20, 2003, Rensselaer School of Eng., www.eng.rpi.edu/soenews/update.do?skinName=print.

* cited by examiner

*Primary Examiner* — Joe Morano, IV

(57) ABSTRACT

A watercraft, typically a catamaran, has at least two spaced hulls; at least one seat mounted on or between the hulls; a vertical axis wind turbine ("VAWT", e.g. Savonius) having a rotatable shaft operatively mounted to the hulls aft of the seat; and at least one propeller operatively connected to the wind turbine. A pedal driven propeller manual assist operable by someone sitting in a seat is also desirably provided. A mounting structure for the VAWT shaft includes an aluminum sleeve receiving the shaft; and at least two aluminum struts extending from each of at least four mounting points on the hulls to the sleeve, the struts operatively connected to the sleeve, one strut from each point vertically above the other. At least two counter-rotating VAWTs, with counter-rotating propellers, are preferred. Typically there are first and second airfoil configuration rudders, one operatively connected to the stern of each hull and controlled by a tiller and linkages to move substantially in tandem. First and second intermeshing gears are connected to the propeller and wind turbine shafts, respectively; and a sealed gear box filled with lubricant contains the gears and is connected to the bottom of the sleeve. A safety mechanism may be utilized, including a plurality of strips of material operatively connected to peripheral portions of the wind turbine so as to rotate with the wind turbine and extend radially outwardly therefrom. Desirably the strips of materiel are flexible and hang substantially limply when the turbine not rotating.

18 Claims, 7 Drawing Sheets

WIND POWERED BOAT

CROSS REFERENCE TO RELATED APPLICATION

This application is based upon provisional. U.S. Application Ser. No. 60/592,140 filed Jul. 30, 2004, which is incorporated by reference herein.

BACKGROUND AND SUMMARY OF THE INVENTION

This application also incorporates by reference U.S. patent application Ser. Nos. 10/443,954 filed May 23, 2003, 10/854,280 filed May 27, 2004, and 11/113,176 filed Apr. 25, 2005, and relates to a wind powered beat.

The wind powered boat according to the present invention provides a unique mounting structure for a vertical axis wind turbine ("VAWT"), such as a Savonius turbine, or open helix turbine. The VAWT illustrated and described in co-pending application Ser. No. 11/113,176 filed Apr. 25, 2005 is preferred. The mounting structure mounts the VAWT to two or more hulls of a multi-hull watercraft, preferably to the two hulls/pontoons of a catamaran.

The mounting structure provides a sleeve for the shaft of the VAWT, and secure support of the sleeve to the hulls. The mounting structure preferably comprises at least two struts (and desirably exactly two struts) extending from each of at least four points (and desirably exactly four points) on the hulls to the sleeve, and the struts are either directly, or through one or more collars operatively connected to the sleeve. The sleeve, struts, and collars (if any) are preferably made of a strong yet light weight and corrosion resistant material, such as aluminum, titanium, or a number of suitable conventional fiber reinforced plastics. Aluminum rods, tubes, or bars, or materials having strength, corrosion resistance, and weight properties substantially similar to aluminum rods, tubes, or bars, are preferred for the struts.

Operatively connected to the bottom of the sleeve there preferably is a gear box having gears that transmit the rotation of the shaft of the VAWT which extends through the sleeve, to rotation of a generally horizontal axis propeller. Desirable gear ratios of the VAWT shaft to the propeller shaft are preferably between about 1:1 to 5:1, e.g. about 2:1. The gear box may be sealed and contain a lubricant, such as oil, to provide optimum lubrication of the gears.

The mounting structure for the VAWT is preferably mounted adjacent the stern of the watercraft, although it may be mounted adjacent the bow. Alternatively, and preferably two counter-rotating VAWTs with counter-rotating propellers are provided, one adjacent the bow and the other adjacent the stern.

The rudder system must be substantial, that is have a large area and provide significant stability. Also, the one or more rudders desirably have an airfoil configuration (as used on conventional Laser class sailboats) so as to minimize drag and enhance rudder effectiveness. Where the preferred catamaran base is utilized, a rudder is preferably mounted adjacent the stern of each hull, and a single operating lever may be provided. Where a pair of seats are provided for the watercraft, the control lever for the rudders is preferably operatively mounted between the seats and a linkage extends to a first rudder. Then (as is conventional per se for some sailing catamarans, such as many Hobiecat® sailboats) a linkage operatively connects the first rudder to the second rudder, so that they move substantially in tandem.

That is, according to one aspect of the invention a watercraft is provided comprising: at least two spaced hulls; at least one seat mounted on or between the hulls; a vertical axis wind turbine operatively mounted to the hulls aft of the seat; and at least one propeller operatively connected to the wind turbine. The watercraft preferably includes a manual assist [the word "assist" does not imply that the pedal mechanism necessarily performs less than ½ of the work to move the watercraft—under some circumstances it may provide more than ½, or even all, of the motive force for moving the watercraft).

Desirably, the manual assist comprises a pedal driven propeller manual assist operable by someone sitting in a seat. The manual assist propeller is distinct from the propeller(s) operatively connected to the wind turbine(s), and can be used to solely move the watercraft forward, to add to the wind driven propeller's forward movement of the watercraft, or—when pedaled backwards—to move the watercraft backwards. The pedal unit per se may be conventional, that is one used on a conventional Seacycle® (see U.S. Pat. No. 5,011,441).

The propeller or propellers (more than one can be used) driven by the or each VAWT is/are preferably of large diameter and large pitch. For example, particularly for a 12-20 foot catamaran base for the watercraft, if a single propeller for a VAWT is used, that propeller may have a diameter of about 15-22 inches (e.g. about 17-20 inches), and have a highly desirable hydrodynamic configuration. Alternatively, two 15 or 16 inch diameter conventional propellers for the Seacycle® pedal unit may be mounted on the propeller shaft (approximately ninety degrees to each other) operatively connected to the VAWT.

The propeller for the pedal mechanism may be the conventional one sold with the Seacycle® pedal unit.

According to another aspect of the present invention, a wind powered watercraft is provided comprising: At least two hulls, and at least two Savonius or helical vertical axis wind turbines operatively connected to at least one of the hulls, and each wind turbine operatively connected to a substantially horizontal axis propeller. The wind turbines and propellers are constructed so that one wind turbine and one propeller rotate clockwise, and one wind turbine and one propeller rotate counterclockwise.

According to another aspect of the present invention there is provided: a mounting structure for a vertical axis wind turbine (desirably, but not necessarily, mounted on a watercraft) having a rotatable shaft. The mounting structure comprises: a sleeve receiving the shaft with the shaft rotating within the sleeve supported by at least one bearing; and at least two struts extending from at or adjacent each of at least four, stationary with respect to the shaft, mounting points to the sleeve, the struts operatively connected to the sleeve. For example exactly two struts extend from at or adjacent each mounting point to the sleeve, a first of the two struts operatively connected (e.g. by welding or mechanical fasteners, with or without a collar) to the sleeve vertically above the second of the two struts; and the sleeve and struts are made of aluminum or a material characteristically similar to aluminum.

According to another aspect of the invention, in the watercraft according to the invention, and/or of the above mentioned patent applications (or even in land mounted wind turbines such as land mounted VAWTs, although likely not as critical there), a safety mechanism is provided. That is, in order to provide an indication as to when a passenger, operator, or other person, is getting too close to the rotating wind turbine, strips of material may be connected to any suitable radial peripheral portions of the turbine so that the strips of material will contact the person before a solid portion of the turbine does, and provide an indication that care should be taken by the person.

According to this aspect of the invention, a safety mechanism for a rotatable wind turbine (e.g. a vertical axis wind turbine mounted on a watercraft) is provided comprising a plurality of strips of material operatively connected to peripheral portions of the wind turbine so as to rotate with the wind turbine and extend radially outwardly therefrom. Preferably the strips of material are flexible and hang substantially limply when the turbine is not rotating. The strips of material may have an airfoil or isosceles triangle configuration in cross section, and may be of at least two different lengths. At least some of the strips may have a plurality of rupturable bubbles having liquid therein.

It is the primary object of the present invention to provide an effective, relatively simple construction, and safe, wind powered boat. This and other objects of the invention will become clear from a detailed description of the invention, and from the appended claims.

DETAILED DESCRIPTION OF THE DRAWINGS

Figure 1:
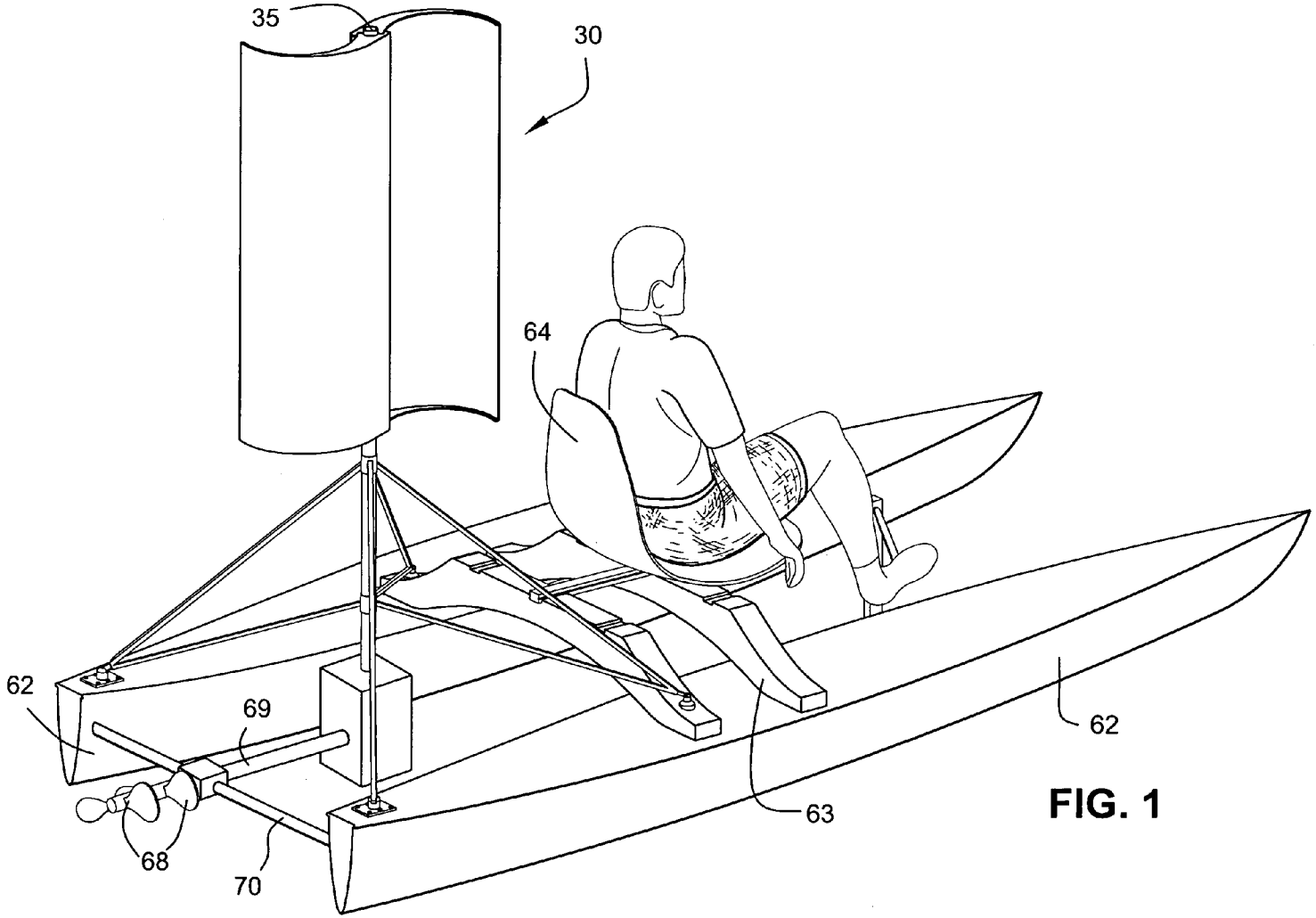
FIG. 1 is rear perspective schematic view of an exemplary wind powered boat according to the invention.
Figure 2:
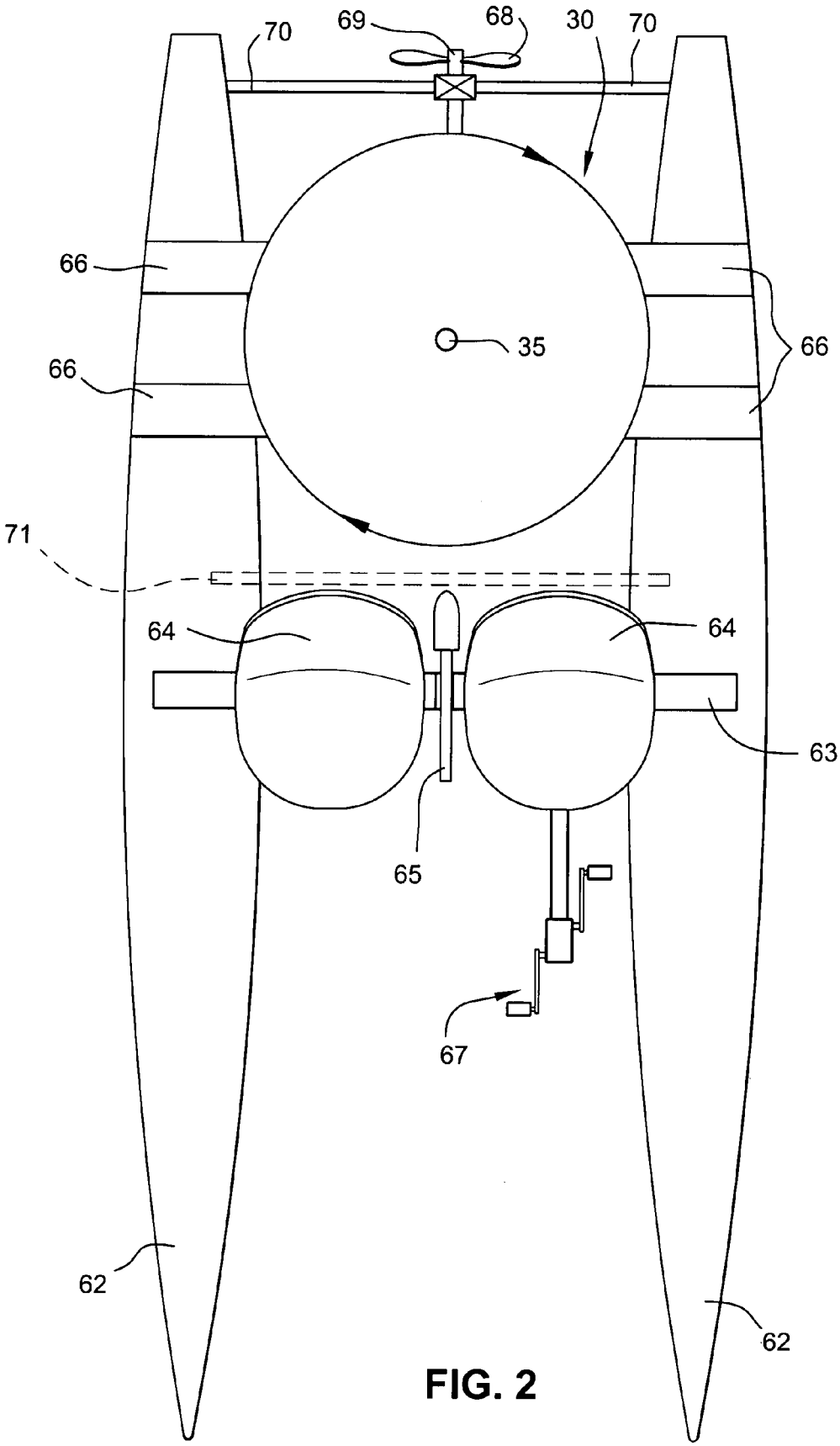
FIG. 2 is a top plan schematic view of another version of wind powered boat according to the invention.

One exemplary watercraft according to the present invention using a vertical axis wind turbine 30, such as a Savonius or open helix wind turbine, is illustrated schematically with respect to a one person SEACYCLE® watercraft 60 (FIG. 1), or two person SEACYCLE® watercraft 61 (FIG. 2). The SEACYCLE® watercraft 60, 61 are catamarans having two hulls/pontoons 62 each with a front support 63 for one or two seats 64, at least one pedal drive mechanism manual assist 67 (with built in propeller, not shown in FIG. 1 or 2, but shown at 72 in FIG. 7), and a rudder assembly 65 accessible from the seat or seats 64. The SEACYCLE® watercraft 60, 61 is modified according to the invention by mounting the vertical axis (e.g. Savonius) wind turbine 30 so that is operatively connected to the hulls 62, e.g. aft of the seat or seats 64, and adjacent the stern. Modified mounts, of any suitable configuration and shown only schematically at 66 in FIGS. 1 & 2, with appropriate conventional bearing assemblies are provided connected to the hulls/pontoons 62.

The turbine 30 is operatively mounted to the pontoons 62 in a position such that when a person is normally seated in a seat 64 he/she has substantially no chance of being impacted by the rotating spokes and vanes of the turbine 30. The safety strips 31, 131 of FIG. 8, hereafter described, are preferably also used. Alternatively, or in addition, an air permeable safety barrier, such as a plastic screen [shown schematically in dotted line at 71 in FIG. 2] may be mounted behind the seat(s) 64 to prevent or retard someone in a seat 64 moving a body part into the path of the turbine 30 when rotating.

The turbine 30 is operatively connected to one or more propellers 68 (two propellers 68 on the same drive shaft 69 are illustrated in FIG. 1, the blades of the propellers 68 in FIG. 1 offset from each other about ninety degrees) by any suitable shaft or gearing arrangement, such as shown in the above identified applications. [The term "operatively connect" and its variations (e.g. "operatively connecting", "operatively connected to", etc.) mean—as they typically do—any connection that allows the components to function to achieve a desired result.] The mount for the drive shaft 69 is shown schematically at 70 in FIGS. 1 & 2, and may be any suitable structure that operatively connects to the pontoons 62 (either directly or through some other mechanism) and properly supports the shaft 69 to allow effective rotation of the propeller(s) 68.

Figure 3:
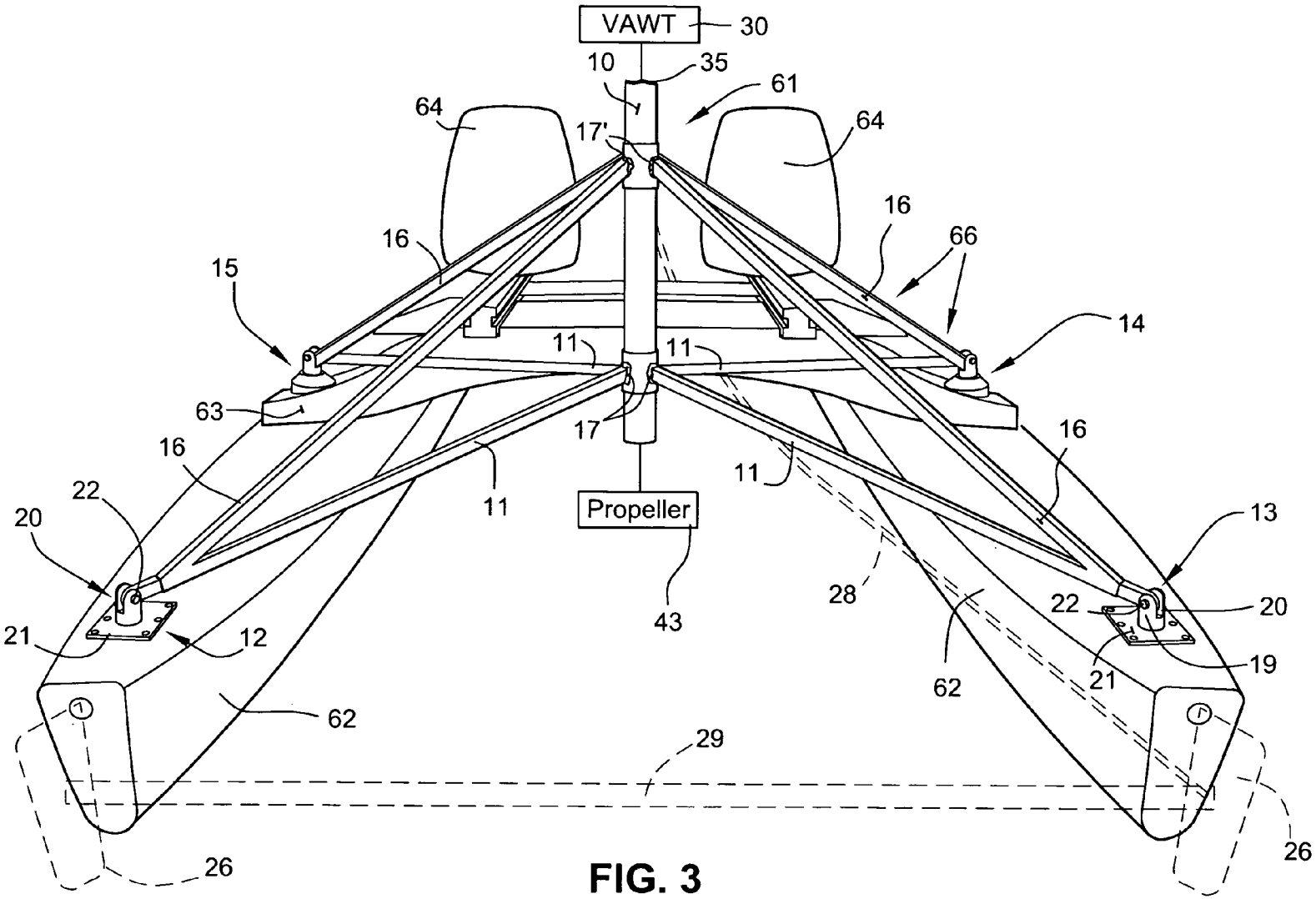
FIG. 3 is a detailed perspective view of a preferred form of mounting arrangement for the vertical axis wind turbine of the boat of FIG. 2.
Figure 3A:
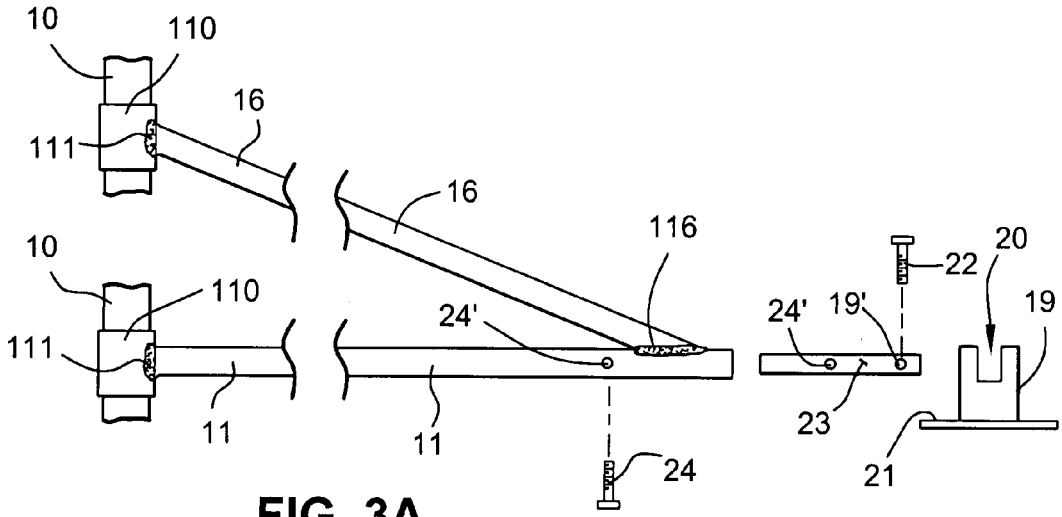
FIG. 3A is a detailed exploded side view of one of the strut sets of FIG. 3 illustrating components thereof.

One particularly desirable form of a mounting structure 66 for a VAWT on a watercraft like the watercraft 61 is shown most clearly in FIGS. 3 & 3A. The structure 66 provides a sleeve 10 for receiving the shaft 35 of the VAWT 30, and a secure support of the sleeve 10 to the hulls 62. The mounting structure 66 preferably comprises at least two struts (and desirably exactly two struts) extending from each of at least four points (and desirably exactly four points) on the hulls 62 to the sleeve 10, and the struts are welded (e.g. at 17) or otherwise operatively connected to the sleeve 10, either directly or through one or more collars 110 [labeled in FIG. 3A]. FIG. 3 illustrates main, almost horizontal, struts 11 coming from each of the mounting points 12, 13, 14 & 15 of the hulls 62, and connected to a lower portion of the sleeve 10. Secondary, upwardly angled, struts 16 are preferably attached to the main struts 11 adjacent, but slightly spaced from, the mounting points 12-15, and are operatively connected (e.g. at 17') to the sleeve 10 vertically above the main struts 11.

The mounts at the mounting points 12-15 may be any structures that operatively connect the struts 11, 16 to the hulls 62 in a stable, secure, and long-lasting manner. For example for the mounting points 12 and 13 each of the mounts 18 may comprise a post 19 with a channel 20 at the top thereof, the post secured to or integral with a plate 21 which is in turn operatively connected (e.g. securely fastened by mechanical fasteners and adhesive) to a hull 62. The proximate end of the strut 11, or an extension thereof (see FIG. 3A) is received within the channel 20, and a pin 22 operatively connects the strut proximate end to the post 19 in the channel 20.

The mounting points 14, 15 may use the same construction as the points 12, 13, or—as illustrated in FIG. 3—a post 19 may be screw threaded into an already existing internally threaded metal sleeve (not shown) already existing [for a Seacycle®] for a crosspiece 63 on the hulls 62 in back of the seats 64, and then covered with a plastic dome 21'.

FIG. 3A shows exemplary components of one of the strut sets 11, 16 associated with an exemplary mounting point 12, 13, in more detail. The struts 11, 16 are square cross-section aluminum tubes, welded together at 116. Each strut 16, 11 is in turn welded (e.g. at 111), or connected by mechanical fasteners, etc., to a collar 110. The collar 110 is in turn operatively connected to the sleeve 10 either with removable fasteners, by welding, or without any secure attachment (e.g. one collar 110 theoretically is free to move slightly along the sleeve 10).

FIG. 3A also shows a bar 23, e.g. of aluminum, which fits within the hollow interior of the strut 11, and is connected thereto by a bolt 24 passing through aligned holes 24' in the bar 23 and strut 11. The pin 22 actually passes through a hole 19' in the bar 23 aligned with holes in the post 19 when the bar 23 is received within channel 20.

Figure 7:
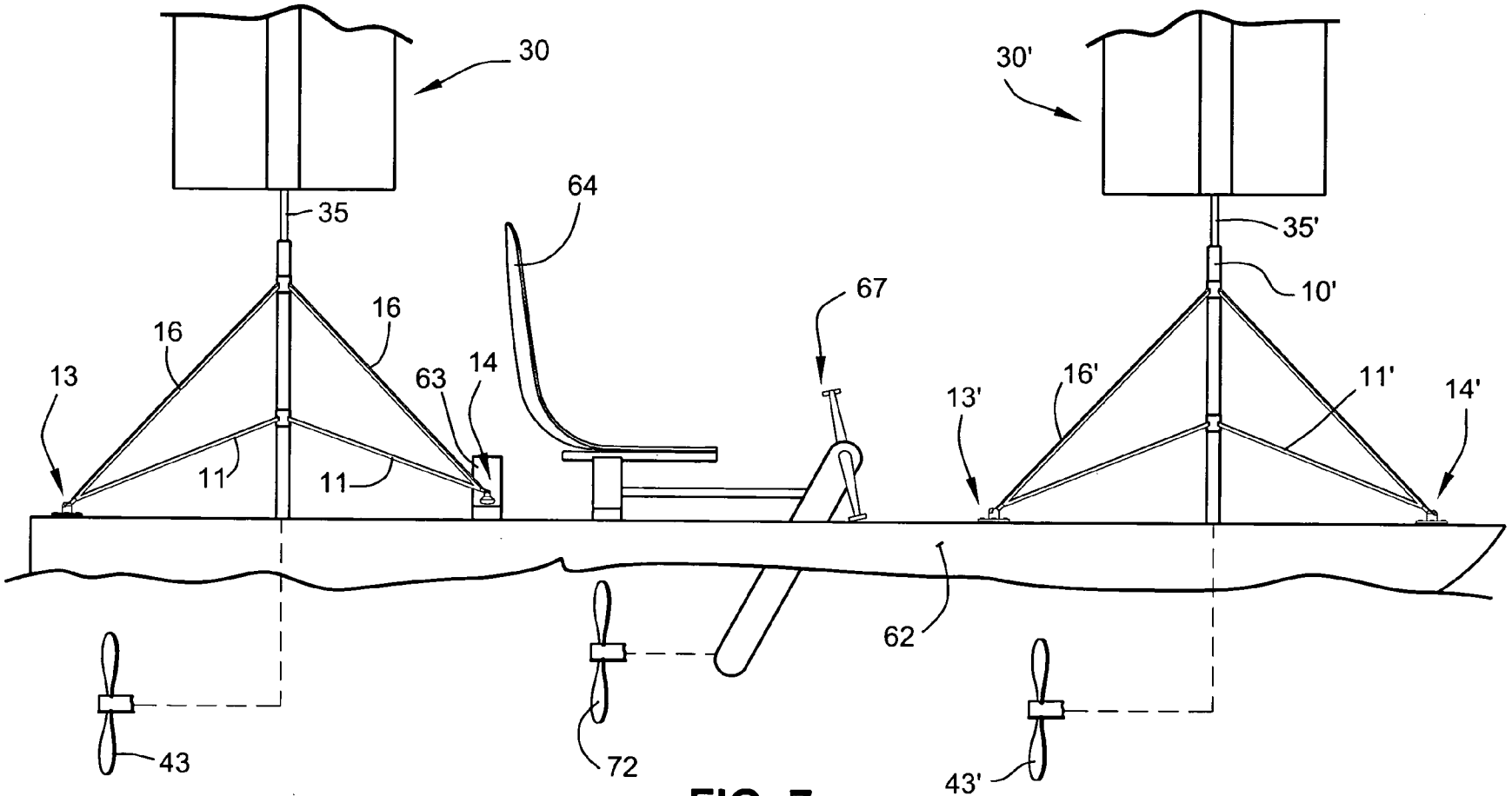
FIG. 7 is a schematic side view of the boat of FIGS. 3-6 only having a longer catamaran base, and showing two VAWTs associated therewith, one fore of the seats and the other aft of the seats.

The sleeve 10 and struts 11, 16 (as well as the posts 19, plates 21, collars 110, and pins 22, where provided) are preferably made of a strong yet light weight and corrosion resistant material, such as aluminum, titanium, or a number of suitable conventional fiber reinforced plastics. Aluminum rods, tubes (round or polygonal—for example square—in cross-section), or bars, or materials characteristically similar to (that is having strength, corrosion resistance, and weight properties substantially similar, including superior to) aluminum rods, tubes, or bars, are preferred for the struts 11, 16. The sleeve 10 is preferably an aluminum tube, or a tube of a material characteristically similar to aluminum.

Where one VAWT 30 is provided, the mounting structure 66 for the VAWT 30 is desirably mounted adjacent the stern of the watercraft 61, although it may be mounted adjacent the bow. Alternatively, and preferably, two counter-rotating VAWTs 30 with counter-rotating propellers 43 are provided mounted by mounting structures 66. One, e.g. clockwise, VAWT 30 (e.g. with clockwise propeller 43) is mounted adjacent the bow and the other, e.g. counterclockwise, VAWT 30 (e.g. with counterclockwise propeller 43) adjacent the stern, as schematically illustrated in FIG. 7. Alternatively both VAWTs 30 may be mounted fore of the seats 64 and/or adjacent the bow, or both may be mounted aft of the seats 64 and/or adjacent the stern.

The rudder system 25 (see FIG. 4 in particular) for the watercraft 61 must be substantial, that is have a large area and provide significant stability. The rudder system 25 must be vastly different than the rudder system for a conventional SEACYCLE®. Preferably two rudders 26 are provided one operatively connected to each hull 62. Preferably the rudders 26 are mounted by conventional quick disconnects to the hulls 62, adjacent the stern of each hull 62. Each rudder 26 desirably has an airfoil configuration (as used on conventional Laser class sailboats, each rudder 26 also typically having dimensions comparable to that of a rudder for a conventional Laser class sailboat) so as to minimize drag and enhance rudder effectiveness. A single operating lever/tiller 27 may be provided. Where a pair of seats 64 are provided for the watercraft 61, the control lever/tiller 27 for the rudders 26 is preferably operatively mounted between the seats 64. A first linkage 28 preferably comprises an aluminum link operatively pivotally connected at the respective ends thereof to part of the tiller 27 and to a first rudder 26 (the bottommost rudder in FIG. 4). Then (as is conventional per se for some sailing catamarans, such as many Hobiecat® sailboats) a second linkage 29 (e.g. an aluminum link operatively pivotally connected at the ends thereof to the rudders 26) operatively connects the rudders 26 together, so that the rudders 26 move substantially in tandem.

Figure 5:
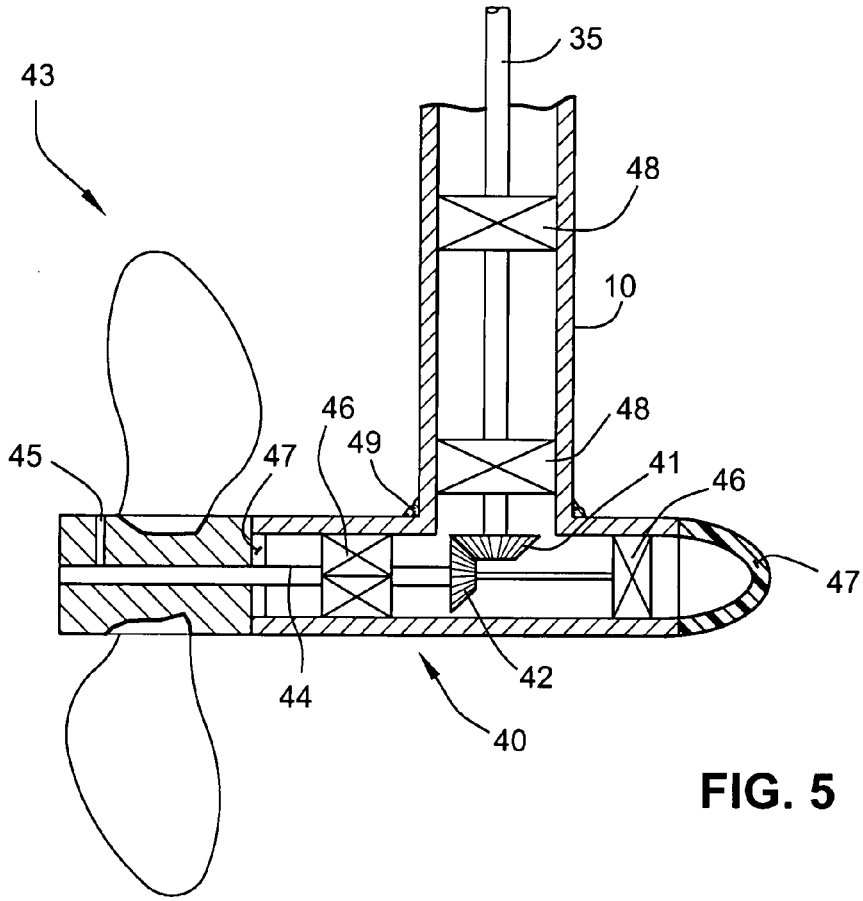
FIG. 5 is a detailed schematic view showing the mounting of the propeller shaft of the boat of FIGS. 3 & 4.

Operatively connected to the bottom of the sleeve 10 there preferably is a gear box 40 having gears (e.g. bevel or worm gears, shown only schematically at 41. 42 in FIG. 5) that transmit the rotation of the shaft 35 of the VAWT 30 which extends through the sleeve 10, to rotation of a generally horizontal axis propeller 43 mounted on propeller shaft 44. The propeller 43 may be operatively connected to shaft 44 by a conventional pin 45. Desirable gear ratios of the VAWT shaft 35 to the propeller shaft 44 are preferably between about 1:1 to 5:1 (e.g. about 2:1).

The gear "box" 40 may be an aluminum tube welded at 49 (see FIG. 6 in particular), or otherwise operatively connected, to the sleeve 10. The gear box 40 preferably has two or more bearings 46 supporting the shaft 44 at opposite sides of the propeller shaft gear 42. The gear box 40 may be sealed, as indicated by seals 47 in FIG. 5, and contain a lubricant, such as oil, to provide optimum lubrication of the gears 41, 42. The VAWT shaft 35 is supported by two or more bearings 48 within the sleeve 10 for rotation therein.

Figure 6:
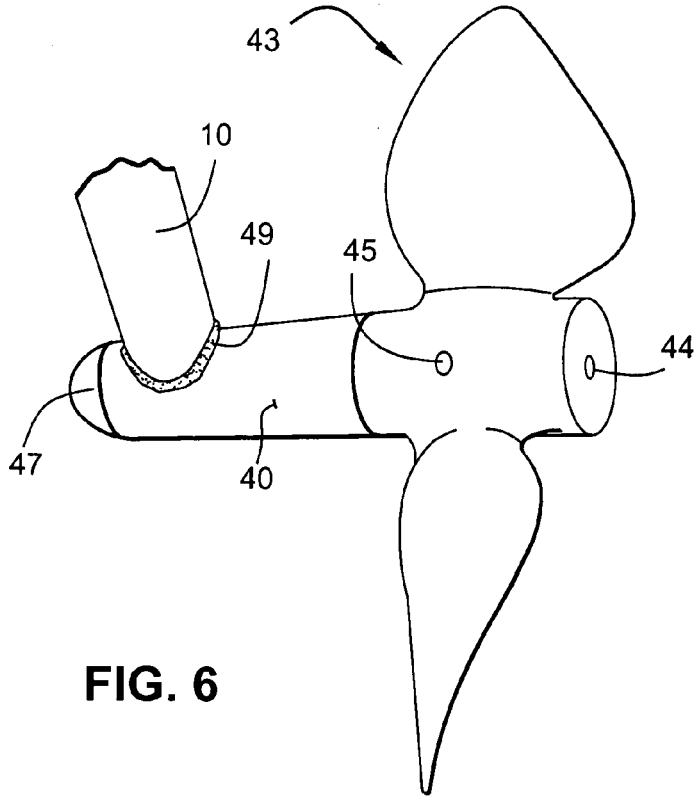
FIG. 6 is a perspective view of a desirable exemplary propeller of the boat of FIGS. 3-5.

Two fifteen or sixteen inch diameter conventional propellers 68 for the Seacycle® pedal unit 67 may be used as the propeller 43. However, a more desirable configuration of the propeller 43 is seen in FIG. 6. In this embodiment, the propeller 43 is a two bladed propeller having a large diameter and large pitch. For example, particularly for a 12-20 foot catamaran base 62 for the watercraft 61, the propeller 43 may have a diameter of about 14-22 inches (e.g. about 17-20 inches), and have the highly desirable hydrodynamic configuration illustrated in FIG. 6. The "hydrodynamic configuration" is one constructed according to a computer program based on SAE Technical Paper #790585, 1979, by E. E. Larrabee entitled "Practical Design of Minimum Induced Loss Propellors" inputting design speed, power, and rpm.

The propeller 72 (see FIG. 7) for the pedal mechanism 67 may be the conventional one sold with the Seacycle® pedal unit, e.g. a thirteen inch propeller. The pedal mechanism 67 may be manually powered by a rider in one direction to move the watercraft 61 forward, and in the opposite direction to move the watercraft 61 backward. The manual assist propeller 72 is distinct from the propeller 43 operatively connected to the wind turbine 30, and can be used to solely move the watercraft forward, to add to the wind driven propeller's forward movement of the watercraft, or—when pedaled backwards—to move the watercraft 61 backwards.

Figure 4:
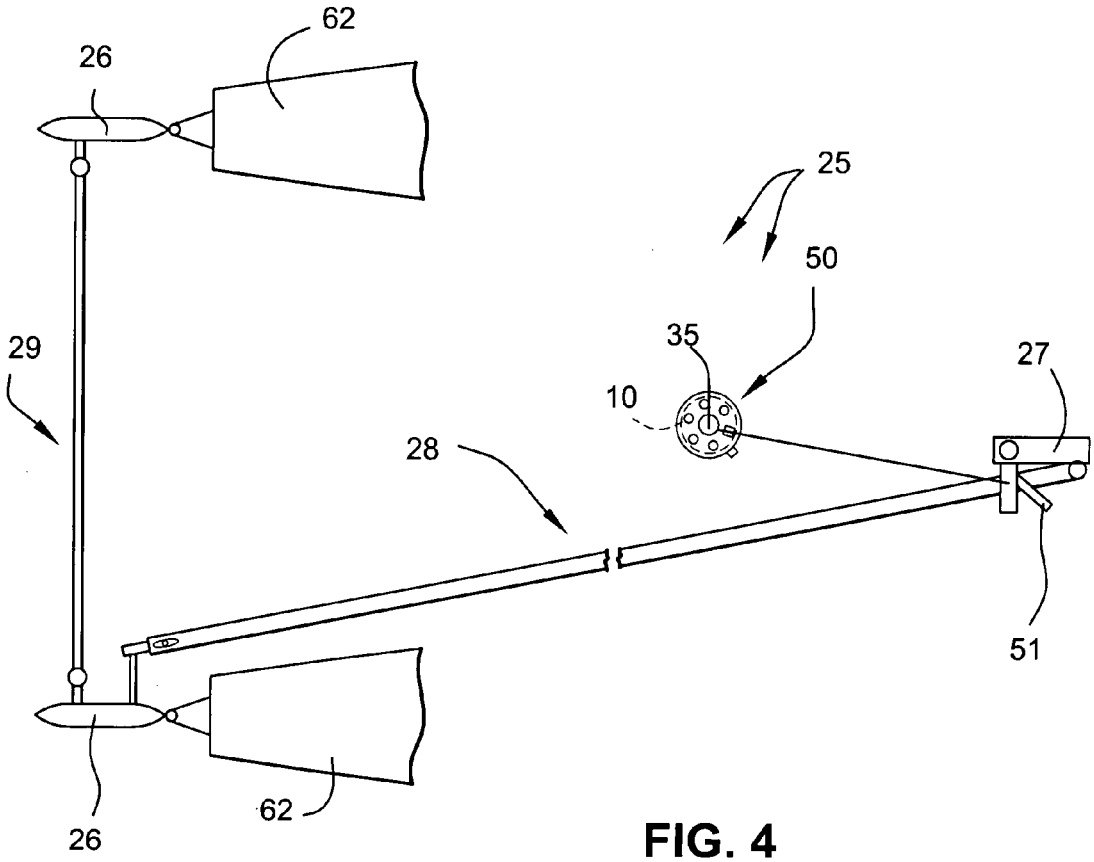
FIG. 4 is a top schematic view showing the mounting of the rudders for the boat of FIG. 3.

As described in co-pending U.S. application Ser. No. 10/443,954 filed May 23, 2003, a brake and/or clutch may be provided for the shaft 35. FIG. 4 schematically illustrates a conventional tricycle disc brake assembly 50 operatively connected to the shaft 35, mounted on sleeve 10. The conventional assembly 50 may include a conventional lockable (in the braking position) lever 51 for actuating the disc brake through a Bowden cable, and operatively connected to the tiller 27 for easy access by the operator of the watercraft 61.

If a clutch like that in the '954 application is provided, the operative components thereof may include a forked lever extending through an opening in the sleeve 10 and selectively cooperating with a disc or collar (not shown) on the shaft 35, with an operating lever operatively connected to the tiller 27, or a separate operating lever provided.

In the watercraft according to the invention, and/or of the above mentioned patent applications (or even in land mounted wind turbines such as land mounted VAWTs, although likely not as critical there), a safety mechanism is sometimes desirably provided. That is, in order to provide an indication as to when a passenger, operator, or other person, is getting too close to the rotating wind turbine 30, strips of material may be connected to any suitable radial peripheral portions of the turbine 30 so that the strips of material will contact the person before a solid portion of the turbine does, and provide an indication that care should be taken by the person.

Figure 8:
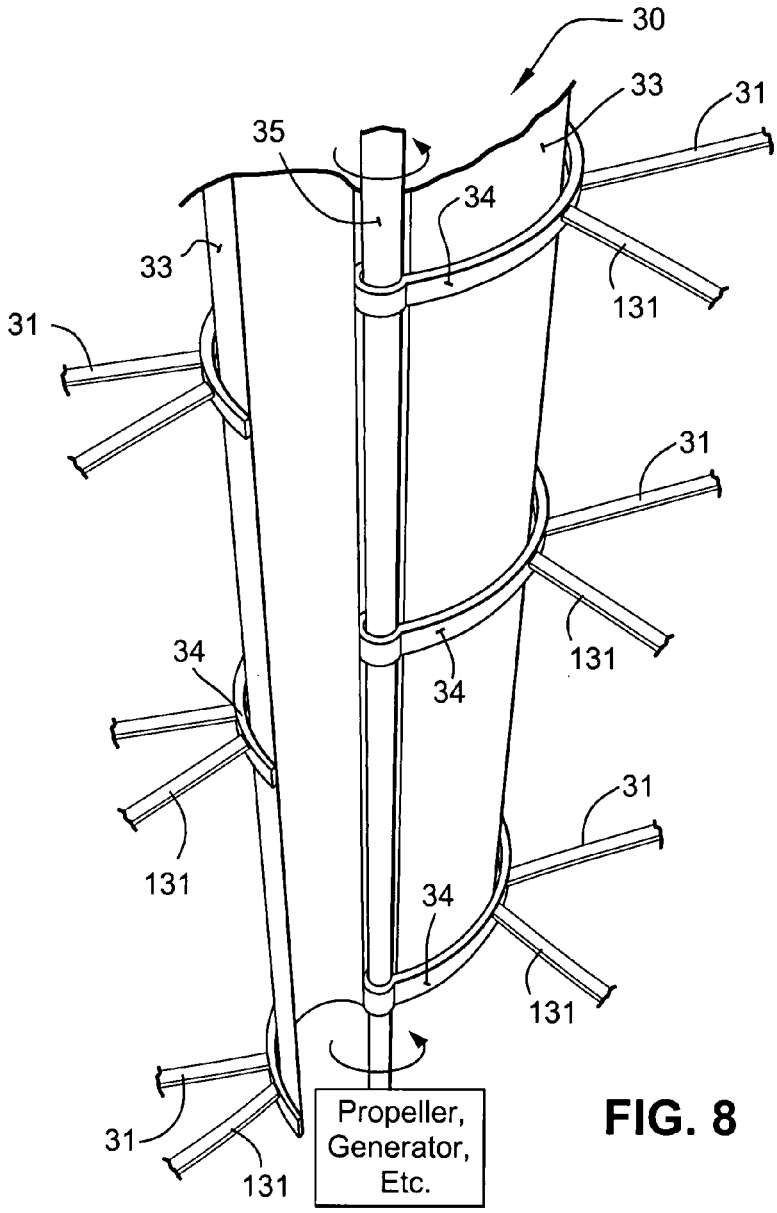
FIG. 8 is a schematic isometric view of an exemplary Savonius vertical axis wind turbine used on the boat of FIG. 3 utilizing a flexible strip safety mechanism according to the present invention.

One exemplary embodiment of safety strips according to the invention is illustrated in the schematic isometric view of FIG. 8 wherein the Savonius vertical axis wind turbine 30 is shown rotating and has strips of material 31, 131 connected at various portions thereof.

The strips 31, 131 are preferably flexible; when the strips 31, 131 rotate with the turbine 30 centrifugal force causes them to be substantially radial, as illustrated in FIG. 8, but when the turbine 30 stops rotating, at least the strips 31 hang limply downwardly. The strips 131 may also hang limply, or somewhat limply, downwardly, or may be stiff enough to stay at least somewhat radial. In FIG. 8 the strips 31, 131 are shown connected to the generally radial spokes 34 for the vanes 33, but depending upon the configuration and materials of the turbine 30 may be connected to other or additional structures.

Figure 9:
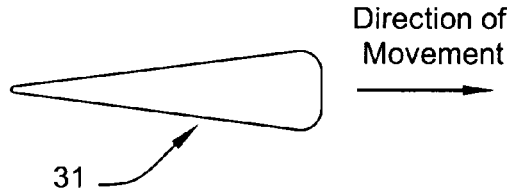
FIGS. 9 & 10 are detailed side schematic view of two different exemplary forms that the flexible strips of FIG. 8 may take.
Figure 10:
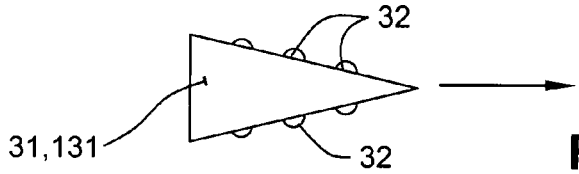

The strips 31, 131 may be of any suitable cross-sectional configurations, any configuration in plan, any length, and of any suitable material so that they provide an indication that the turbine 30 solid portions are close while not significantly interfering with rotation of the turbine 30. For example the strips 31—as seen in FIG. 9—may have an airfoil configuration in the direction of expected rotation, may be of plastic, rubber, cloth, or the like, of any suitable thickness, and may also be constructed or perforated so that they make a relatively quiet but discernable noise when rotating at least part of the expected rotational speed range of the turbine 30. Also, as shown in FIG. 10, the strips 31, 131 may have portions thereof—such as the bubbles 32 in FIG. 10—which either accentuate the sound or break and release liquid, when they impact something (presumably a person who is too close), to provide yet a more definitive indication to the person that he/she is too close. Also, variable length strips can be provided, the longest 31 of relatively light weight material providing a first indication, and the shortest 131 of heavier material to provide a more positive indication when impacting a person.

The strips 31, 131, may be operatively connected to the turbine 30 by any suitable mechanism. For example cooperating hook and loop fasteners may be provided on the strips 31, 131 and a spoke, vane, or other part of the turbine 30, or more permanent connections (such as adhesive or mechanical fasteners) may be utilized.

While all parameters of the strips 31, 131 are variable to achieve the desired safety indication results, according to one example: The strips 31 have a length of about 18 inches, an airfoil cross-section, and are made of plastic having a thickness of about ¼ inch or less (which may or may not taper from the point of connection to turbine 30 to the free ends thereof), and have bubbles 32 having a liquid such as alcohol or colored water therein, which bubbles 32 break on impact with a person and provide a wet sensation to the person's skin. The strips 31 hang substantially limp when the turbine 30 is not rotating. And the strips 131 have an isosceles triangle configuration in cross section, a length of about 9 inches, are made of a more rigid plastic than are strips 31, and have about 2-5 times the thickness of the strips 31 (and also may or may not taper from the point of connection to the turbine 30 to the free ends thereof). The strips 131 also hang substantially limp when the turbine 30 is not rotating.

While the safety/indicating strips 31, 131 are illustrated and described with respect to a VAWT 30, under some circumstances they also could be used with a horizontal axis wind turbine, or other conventional or hereafter developed types of wind turbine rotors.

The invention is to be accorded the broadest interpretation possible, limited only by the prior art, and to encompass all equivalents to what is set forth in the appended claims. Also, all numerical values are approximate, and all narrow ranges within a broad range are specifically included herein.

What is claimed is:

1. A watercraft comprising: at least two spaced hulls; at least one seat operatively mounted to the hulls; a vertical axis wind turbine having a rotatable shaft operatively mounted to the hulls aft of the seat; at least one generally horizontal propeller operatively connected to the wind turbine; and a pedal driven propeller manual assist operable by someone sitting in a seat.

2. A watercraft as recited in claim 1 further comprising a mounting structure for the vertical axis wind turbine shaft comprising: a sleeve receiving the shaft; and at least two struts extending from each of at least four mounting points on the hulls to the sleeve, the struts operatively connected to the sleeve.

3. A watercraft as recited in claim 2 wherein the watercraft comprises a catamaran having two hulls; and wherein exactly two mounting points are provided on each of the two hulls, and wherein exactly two struts extend from at or adjacent each mounting point to the sleeve, a first of the two struts operatively connected to the sleeve vertically above the second of the two struts.

4. A watercraft as recited in claim 3 wherein the sleeve and struts are made of aluminum or a material characteristically similar to aluminum.

5. A watercraft as recited in claim 1 wherein the watercraft comprises a catamaran having two hulls; and further comprising first and second rudders, one operatively connected to the stem of each hull; a tiller disposed adjacent a seat and operable from the seat; a first linkage operatively connecting the tiller to the first rudder; and a second linkage operatively connecting the first rudder to the second rudder so that the rudders move substantially in tandem.

6. A watercraft as recited in claim 5 wherein the rudders each have an airfoil configuration.

7. A watercraft as recited in claim 1 wherein the propeller has a diameter of at least about fourteen inches, and a hydrodynamic configuration.

8. A watercraft as recited in claim 1 wherein the propeller is mounted on a propeller shaft; and further comprising: first and second intermeshing gears connected to the propeller and wind turbine shafts, respectively; and a gear box containing the gears.

9. A watercraft as recited in claim 8 wherein the gear box comprises a tube of aluminum or a material characteristically similar to aluminum; and further comprising a mounting structure comprising a sleeve receiving the wind turbine shaft, and at least two struts extending from each of at least four mounting points on the hulls to the sleeve, the struts operatively connected to a bottom portion of the sleeve.

10. A watercraft as recited in claim 1 wherein the vertical axis wind turbine comprises a first turbine and the propeller comprises a first propeller; and further comprising a second vertical axis wind turbine operatively mounted to the hulls adjacent the bow and fore of the at least one seat, the second wind turbine rotating in an opposite direction to the first turbine, and operatively connected to a second propeller which counter rotates with respect to the first propeller.

11. A watercraft as recited in claim 1 further comprising a safety mechanism including a plurality of strips of material operatively connected to peripheral portions of the wind turbine so as to rotate with the wind turbine and extend radially outwardly therefrom, at least some of the strips of material being flexible and hanging substantially limply when the turbine is not rotating.

12. A safety mechanism for a rotatable wind turbine, comprising a plurality of strips of material operatively connected to peripheral portions of the wind turbine so as to rotate with the wind turbine and extend radially outwardly therefrom.

13. A safety mechanism as recited in claim 12 wherein the wind turbine is a vertical axis wind turbine mounted on a watercraft.

14. A safety mechanism as recited in claim 13 wherein the strips of material are flexible and hang substantially limply when the turbine is not rotating.

15. A safety mechanism as recited in claim 12 wherein the strips of material have an airfoil or isosceles triangle configuration in cross section, and are of at least two different lengths.

16. A safety mechanism as recited in claim 12 wherein at least some of the strips have a plurality of rupturable bubbles having liquid therein.

17. A wind powered watercraft comprising: at least two spaced hulls, and at least two Savonius or helical vertical axis wind turbines operatively connected to at least one of said hulls, and each wind turbine operatively connected to a substantially horizontal axis propeller; and said wind turbines and propellers constructed so that one wind turbine and one propeller rotate clockwise, and one wind turbine and one propeller rotate counterclockwise.

18. A watercraft as recited in claim 17 further comprising a pedal driven propeller manual assist operable by someone sitting in a seat on said watercraft.

* * * * *